United States Patent [19]

Lederman

[11] 4,011,611

[45] Mar. 15, 1977

[54] OUTDOOR BEAN BAG

[75] Inventor: Steven N. Lederman, Beverly Hills, Calif.

[73] Assignee: Lederman's Incorporated, Los Angeles, Calif.

[22] Filed: Sept. 26, 1975

[21] Appl. No.: 617,034

[52] U.S. Cl. ..... 5/361 B; 5/335; 297/456

[51] Int. Cl.[2] ..... A47C 27/00

[58] Field of Search ..... 5/344, 361 B, 335, 339; 9/12, 13, 347, 348; 297/456, DIG. 2

[56] References Cited

UNITED STATES PATENTS

| | | | |
|---|---|---|---|
| 3,459,179 | 8/1969 | Olesen | 5/361 R X |
| 3,480,280 | 11/1969 | Gamertsfelder | 5/361 R X |
| 3,601,826 | 8/1971 | Smith | 5/335 |
| 3,740,095 | 6/1973 | Nail | 297/347 X |
| 3,899,210 | 8/1975 | Samhammer et al. | 5/361 B X |

*Primary Examiner*—James C. Mitchell
*Attorney, Agent, or Firm*—Blakely, Sokoloff, Taylor & Zafman

[57] ABSTRACT

An outdoor bean bag comprising a nonexpandable water resistant fabric, forming a substantially closed bag, and a multiplicity of resilient, flowable pellets partially filling the bag. In a preferred embodiment, the outdoor bean bag is fabricated from woven nylon fabric and partially filled with expanded polystyrene foam pellets to a degree which optimizes comfort. The bag is intended for, but not limited to, use out of doors, such as on the beach, the decks of boats, patios, pool sides, and in water. Inasmuch as this invention floats on water, it is also suitable for use as a personal flotation device.

6 Claims, 4 Drawing Figures

OUTDOOR BEAN BAG

DISCLOSURE DOCUMENTS

This application is based at least in part upon the information filed at the U.S. Patent Office on July 16, 1974 under the Disclosure Document Program, No. 033,784.

BACKGROUND OF THE INVENTION

1. Field of the Invention

The present invention relates primarily to the field of outdoor furniture and secondarily to personal flotation devices: more particularly it relates to the field of bean bag furniture adaptable for outdoor and aquatic usage.

2. Description of the Prior Art

The bean bag as an article of furniture is generally known in the art of interior design and furnishing. The cover of a conventional bean bag is typically made out of an expandable material, such as polyvinyl chloride. The cover is typically expandable in order to allow the resilient, flowable pellets which partially fill the bag to flow easily therein, thus enabling the bag to conform to contours of the user's body. If the cover of a conventional bean bag were not made of such expandable material, the cover would tend to restrict the flow of the pellets and to cause them to pack under the user's weight rather than to flow resulting in a relatively hard and uncomfortable seat.

The expandable polyvinyl chloride cover, used in conventional bean bags, is unsuitable for use in an outdoor environment where it would be subjected to prolonged exposure to temperature extremes, water and solar radiation. Such exposure would cause significant deterioration of the cover in a relatively short time. In addition, the polyvinyl chloride material with backing used in the conventional bean-bag, would permit and aid the growth of mildew when used outdoors. While water-resistant materials which are compatible with outdoor exposure are known in the art, they are typically non-expandable. Thus, before the present invention, they have not been considered suitable for use as a bean-bag cover because their non-expandability results in a relatively hard and uncomfortable bean-bag. Consequently the bean-bag was relegated exclusively to indoor use. However, the present invention makes use of such water-resistant material as a bean-bag cover while achieving an acceptable degree of comfort. Thus, by virtue of this invention, the comfort, convenience and enjoyment of the bean-bag has been extended to the entire world of outdoor living, sports and activity.

The art of design and fabrication of personal flotation devices (hereinafter referred to as PFD's), such as life saving equipment, is old and well developed. Inventive activity in this field of art has gone beyond the design of PFD's for use only in emergency situations, and now includes designs suitable for dual functions. For example, the prior art discloses PFD's capable of serving both as a life preserver and as objects of water sports. However, such devices are designed to function exclusively in water and have no other use.

The prior art also discloses various articles of furniture which can function as a PFD in a water-related emergency. For example, an air-filled or solid filled seat cushion for use on boats has been designed to also serve as a life vest or buoy. Another example is a shipboard sleeping mattress which is convertable into a life raft. In general, the dual-purpose furniture known in the prior art has been filled with air or soild floatable particles such as cork or wood shavings. More recently, solid air filled elements, such as closed cell foamed plastic and ping pong balls have been employed as the flotation means. However, in most cases, the item of dual-purpose furniture has a measure of rigidity attributable to either (i) use of a semi-rigid foam material, (ii) rigid structural members, or (iii) a semi-rigid inflatable form defined by the ribs, seams and panelling of an exterior covering. In the case of air filled or inflatable dual-purpose furniture, these items generally lack the structural support required of outdoor furniture. Furthermore, many PFD's known in the art, while useable as outdoor furniture in their original state, are not so useable again, once they have been used as a PFD in a water-related emergency. This is due to poor drainage of the PFD and the use of materials which, while perhaps less expensive, are not water resistant. The present invention overcomes this limitation of the prior art and retains its dual capability as outdoor furniture and PFD.

SUMMARY OF THE INVENTION

The present invention is an outdoor bean bag capable of providing a substantial measure of conforming comfort and support in outdoor and aquatic environments simultaneously, having prolonged life even when subjected to the effects of sun, heat, salt, wind and water. The cover of the outdoor bean bag is fabricated from a water resistant material and is partially filled with resilient flowable pellets similar to those used in conventional bean bags. The cover is flexible and forms a generally closed volume which assumes a configuration dictated by the disposition of the user's weight and the resistance provided by the confined pellets.

In one embodiment the cover may be a woven nylon fabric although any material resistant to degradation in extreme environments may be utilized. Because woven nylon fabric may be relatively nonexpandable, the amount of pellets used to fill the bag is reduced in order to provide the comfort level which has come to be expected from conventional bean bags. The woven nylon cover also permits water to seep into the interior of the bean-bag when it is in an aquatic environment, and ultimately to escape and evaporate therefrom when removed from such environment. This allows drying of the interior through the cover and precludes the entrapment of stagnant water therein.

DESCRIPTION OF THE PREFERRED EMBODIMENT

Figure 1:
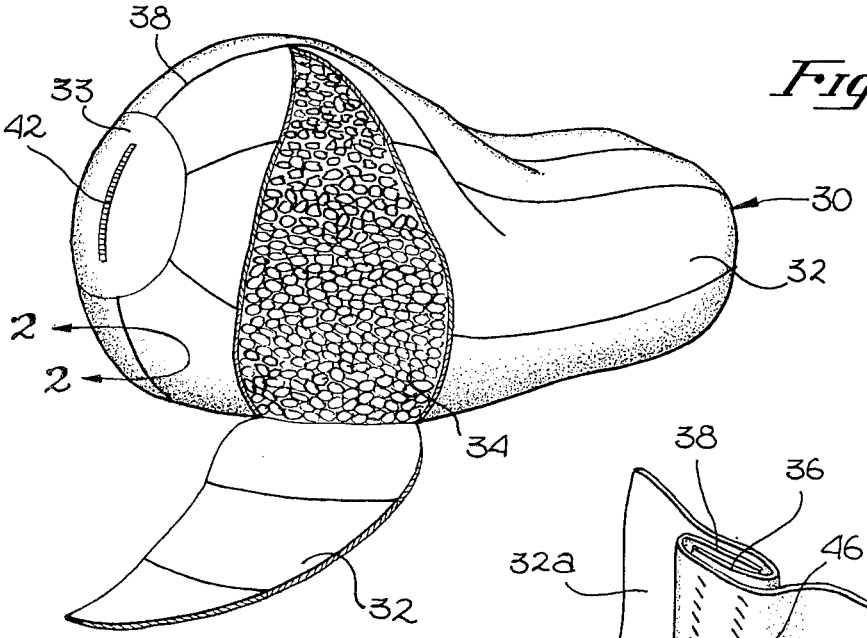
FIG. 1 is a perspective view of the outdoor bean bag in a terrestrial environment with one panel thereof being shown as partially peeled away to illustrate the containment of the resilient flowable pellets therein.

The present invention is an outdoor bean bag comprising a water resistant material forming a generally closed bag which is partially filled with a multiplicity of resilient, flowable and buoyant pellets. In one embodiment of the present invention the water resistant material forming the closed bag may have a resealable access port therein through which the pellets may be removed and inserted.

The present invention can be better understood by referring to the FIGURES. In particular, referring to FIG. 1, many of the elements of the present invention may be described. The outdoor bag 30 is comprised of a covering made from a plurality of sections 32 which are joined together at seams 38 to form a closed bag. The panels typically converge and are joined to a small circular panel 33 at one end or "bottom" of the bag 30 and at a smaller circular panel at the opposite end (not shown). In the preferred embodiment, panels 32 of bag 30 are of a non-expandable woven nylon fabric which is water resistant. While it is not necessary in the present invention that the panels 32 form a waterproof bag, the fabric panels 32 need be water resistant so that they may be capable of withstanding prolonged use in an aquatic or outdoor environment with substantial degradation. Water may in fact seep through the fabric covering 32 and partially or completely fill the interstices between buoyant pellets 34 within bag 30, and a woven fabric has the advantage of breathing sufficiently so as to allow subsequent drying through the covering, thereby avoiding the entrapment of stagnant water within the bag. Although many materials are suitable for aquatic use, woven nylon has been found to be ideally suited for the use contemplated by the present invention, and fabric manufactured by Putman Mills and sold under the Trademark "HUSKY", and by Avila Mills have been approved for aquatic use by the U.S. Coast Guard.

Figure 2:
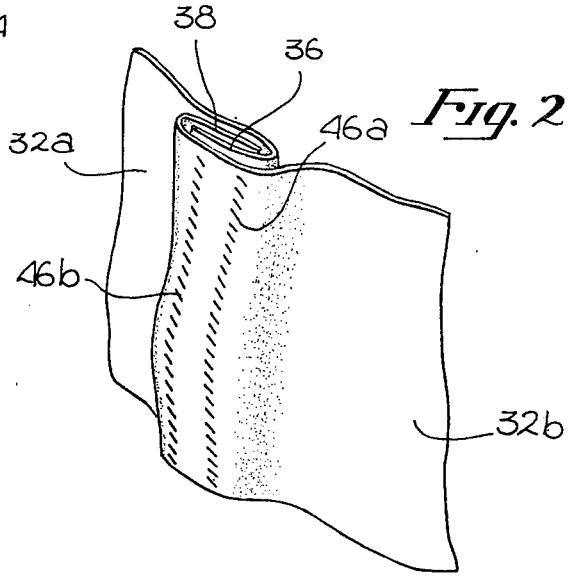
FIG. 2 is an exploded section of a seam of the outdoor bean bag showing the manner in which the covering material is folded and the seam stitched with a double stitch.

FIG. 2 illustrates one method by which the fabric panels 32 may be joined together at seams 38. A seam is formed by two interlocking double folds of panels 32*a* and 32*b*. One fold forms seam edge 38 and the other forms the interior seam edge 36. A double stitch 46*a* and 46*b* is made along the seam through both folds between seam edges 36 and 38, thus penetrating all four layers of the fabric of the two panels 32*a* and 32*b*. Although the stitch as illustrated in FIG. 2 has been found to be an economical and convenient way of joining panels 32 in a secure manner, and is capable of withstanding adverse exterior environments, panels 32 may be joined by a number of other ways, including by way of example, a single "baseball" stitch, "jeans" stitch or other similar means. Such a double stitch 46 appears to be a novel means for joining panels of woven nylon material.

Figure 3:
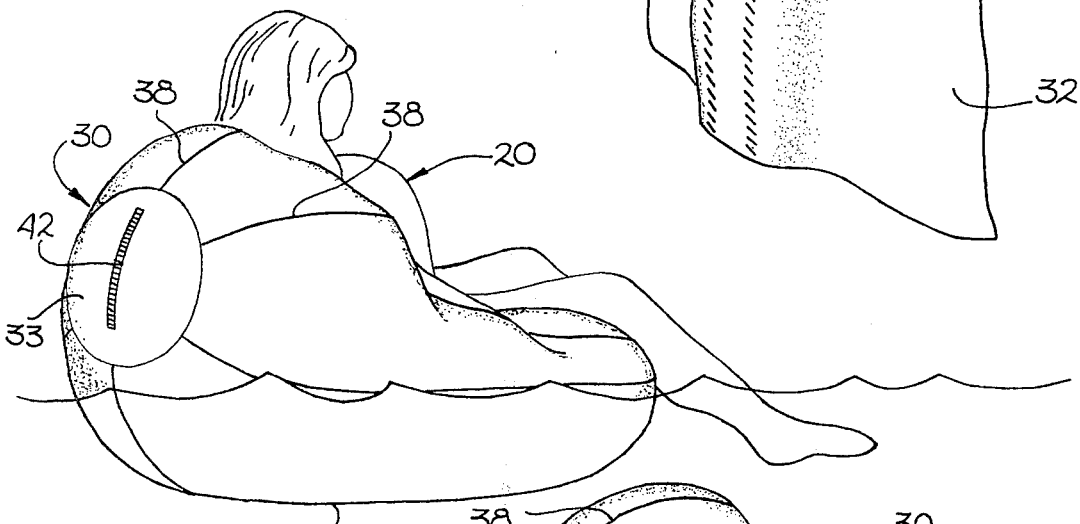
FIG. 3 is a perspective view of the outdoor bean bag being used in a dual purpose function as a personal floatation device and as an article of recreational furniture in an aquatic environment.
Figure 4:
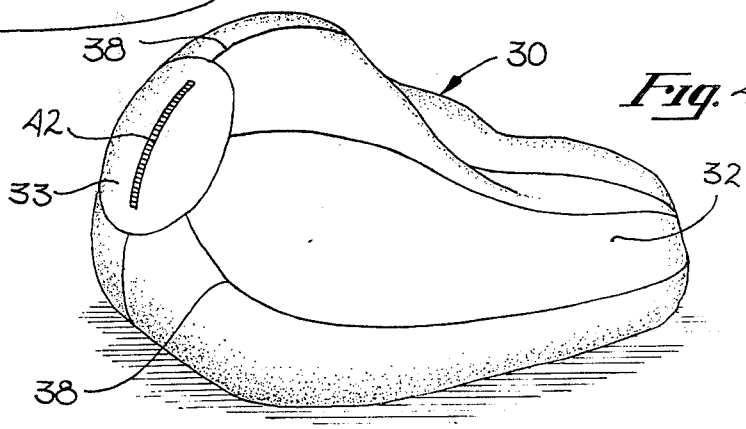
FIG. 4 is another embodiment of the outdoor bean bag showing its use in conjunction with a resealable access port.

Referring now to FIGS. 1, 3 and 4, an additional and optional feature of the present invention is shown: namely, the incorporation of a resealable access port 42 located in the small circular end panel 33. Access port 42 is a resealable slit, positioned in the panel 33, having a sufficient length to allow the convenient extraction or addition of pellets 34 from or to bag 30. Also, the resealable access port 42 provides the additional function of providing a means whereby water and foreign contaminants may be conveniently removed from the interior of the bag if necessary. It should be understood that while the present invention does not require a resealable access port 42, its incorporation is advantageous in respect to increasing the useful life of the invention. In one embodiment of the present invention, resealable port 42 comprises a nickel plated, heavy duty zipper which is sewn into panel 33. The nickel plating on the heavy duty zipper provides a corrosive resistant surface whereby the port 42 maintains its resealable characteristic without substantial degradation due to adverse elements. However, resealable access port 42 could include any number of various means well known to the art whereby a flexible temporary seal may be made in a fabric or flexible material. For example, a plastic zipper utilizing continuous interlocking channels may be used in place of the nickel plated zipper.

Referring again to FIG. 1, a peeled away panel 32 of bag 30 exposes a portion of pellets 34. The pellets 34 fill only a fraction of bag 30. As previously discussed, this is done to facilitate the flowable characteristic of the mass of pellets 34. However, it is to be noted that in order to provide the substantial measure of conforming comfort normally expected and associated with bean bag furniture, it is necessary to fill a bag covered with a nonexpandable covering to a lesser extent than is commonly the case with conventional bags made with expandable coverings. For example, in a conventional bean bag approximately 8½ cubic feet of pellets 34 are used. This amount fills approximately 65 percent of the total interior volume available within the bag. In contrast, according to the present invention, about 5 to 6 cubic feet of pellets 34, at the most, are placed within the bag of the same basic size, representing a maximum fill of approximately 50 percent of the total available internal volume of bag 30. These amounts, however, are used by way of example only, and are not intended to limit or define the scope of the present invention, which is meant to apply to bags of arbitrary size and volume. Therefore, by lessening the amount of total fill within bag 30, the loss of resiliency and comfort sacrificed by the use of a nonexpandable cover as compared to a conventional bag is substantially compensated. In addition, when used in water, the buoyancy of the water enhances the comfort level enjoyed by a user, who in any case is satisfied with slightly less comfort in an outdoor setting then in an indoor one. Moreover, user satisfaction is further enhanced by virtue of the fact that the invented outdoor bean-bag is entirely compatable with its environment.

Pellets 34 may be of any buoyant material suitable for prolonged use in aquatic environments. When bag 30 is used as a personal floatation device, the buoyancy of the bag is determined by the specific gravity of the positive flotation material, pellets 34, contained therein. Although cork, wood chips and closed cell bubbles such as pingpong balls have been used in such applications, in the preferred embodiment of the present invention, pellets 34 are of expanded polystyrene foam. When new, such pellets have a specific gravity of substantially less than unity. Should the specific gravity of the pellets 34 become degraded by compression through usage in an aquatic environment, it can easily be upgraded by adding fresh pellets 34 through the access port 42. Thus, the beneficial life of outdoor bag 30 can be substantially extended indefinitely. Expanded polystyrene foam pellets do not absorb any significant amount of water, if any. After submersion, they only retain a thin surface film of water. They, therefore, remain relatively light in weight and highly buoyant. One cubic foot of pellets will normally support, in water, approximately 60 pounds in buoyancy. In an adult sized bean-bag 30, there is approximately 5–6 cubic feet of fill. Thus, the present invention provides the capability of supporting an approximate weight of 300–360 pounds in water, a sufficient buoyancy to support most persons, even heavy ones, plus the weight of any water which seeps into the bag.

Finally referring to FIG. 3, a typical use of the outdoor bean bag in an aquatic environment is illustrated. The outdoor bean bag is principally intended to function as an article of equipment or furniture for leisure water and outdoor recreation. However, it is entirely within the scope of the present invention that bag 30 could be fitted with suitable and durable straps such that if, for example, bag 30 is utilized as leisure deck furniture, it may in some cases serve as an emergency personal floatation device. The straps in such case would then serve as convenient and secure hand holds for a distressed swimmer until such time as rescue could be effected. Thus, while the present invention has been disclosed and described with respect to certain embodiments thereof, it will be understood by those skilled in the art that various changes in form and detail may be made therein without departing from the spirit and scope of the present invention.

I claim:

1. An outdoor bean bag comprising:

a multiplicity of resilient flowable pellets having a specific gravity of less than unity; and a flexible, water resistant cover forming a generally closed container filled by said multiplicity of pellets to less than 50 percent of the total interior volume of said container, said cover enclosing said multiplicity of resilient flowable pellets;

wherein said pellets distribute themselves in said water resistant cover so as to conform with and comfortably support the contours of the user's body.

2. The bean bag of claim 1 wherein:

said flexible water resistant cover is a bag of woven nylon fabric; and said bag is partially filled by said multiplicity of resilient flowable pellets.

3. The bean bag of claim 1 wherein:

said pellets are expanded polystyrene pellets.

4. The bean bag of claim 1 further comprising:

a resealable access port to provide a means for inserting and removing said pellets from the interior of said container.

5. The bean bag of claim 1 wherein:

said cover is formed by a plurality of sections stitched together by an interlocking double fold stitch.

6. An outdoor bean bag comprising:

a multiplicity of resilient flowable buoyant pellets made of expanded polystyrene;

a flexible water resistant cover of woven nylon forming a closed container, said container being filled by said pellets to less than 50 percent of the total interior volume of said container;

said cover formed by a plurality of sections thereof stitched together by an interlocking double fold stitch; and a resealable access port to provide a means for inserting and removing said pellets from the interior of said container;

wherein said pellets distribute themselves in said cover so as to conform with and confortably support the contours of the user's body.

* * * * *